US006896645B1

(12) United States Patent
Krull

(10) Patent No.: US 6,896,645 B1
(45) Date of Patent: May 24, 2005

(54) EXERCISE RESISTANCE METHODS AND APPARATUS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 522 days.

(21) Appl. No.: 10/144,338

(22) Filed: May 9, 2002

Related U.S. Application Data

(60) Provisional application No. 60/289,992, filed on May 10, 2001.

(51) Int. Cl.[7] ..... A63B 21/072
(52) U.S. Cl. ..... 482/107; 482/106; 482/108
(58) Field of Search ..... 482/98, 104, 106–109

(56) References Cited

U.S. PATENT DOCUMENTS 850,964 A * 4/1907 Pelletier et al. ..... 482/108
1,316,683 A * 9/1919 Calvert ..... 482/93
1,422,888 A * 7/1922 Reeves et al. ..... 482/93
1,524,888 A * 2/1925 Schuur ..... 482/108
3,612,523 A * 10/1971 Glynn ..... 482/98
3,904,198 A * 9/1975 Jones ..... 482/106
4,529,198 A * 7/1985 Hettick, Jr. ..... 482/104
4,787,628 A * 11/1988 Harwick et al. ..... 482/98
5,102,124 A * 4/1992 Diodati ..... 482/107
5,328,428 A * 7/1994 Huang ..... 482/98
5,971,899 A * 10/1999 Towley et al. ..... 482/108
5,984,843 A * 11/1999 Morton ..... 482/106
6,033,350 A * 3/2000 Krull ..... 482/98

FOREIGN PATENT DOCUMENTS

DE 10237083 A1 * 9/2003

* cited by examiner

*Primary Examiner*—Justine R. Yu
*Assistant Examiner*—Victor K. Hwang

(57) ABSTRACT

First and second weight housings are mounted on opposite ends of a handle. Weights are disposed in first and second vertical stacks on opposite ends of a base member. At least one selector rod is selectively moved into engagement with each weight housing and a desired weight in each of the stacks.

27 Claims, 10 Drawing Sheets

Fig. 24
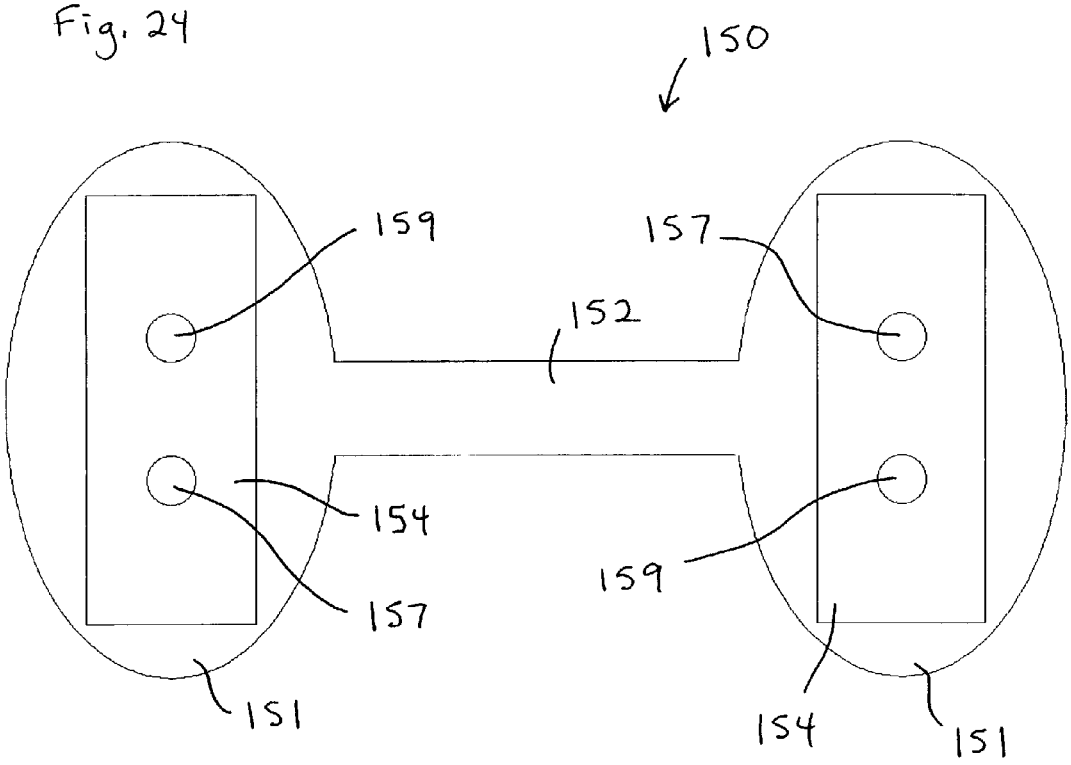
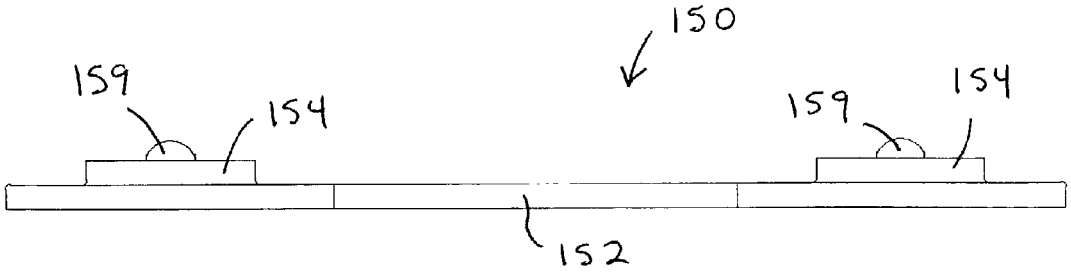
Fig. 25

EXERCISE RESISTANCE METHODS AND APPARATUS

CROSS-REFERENCE TO RELATED APPLICATIONS

Disclosed herein is subject matter that is entitled to the filing date of U.S. Provisional Application Ser. No. 60/289,992, filed on May 10, 2001.

FIELD OF THE INVENTION

The present invention relates to exercise equipment and more particularly, to weight selection methods and apparatus for dumbbells and barbells.

BACKGROUND OF THE INVENTION

Various methods and apparatus have been developed to provide adjustable resistance to exercise. For example, exercise dumbbells are well known in the art and prevalent in the exercise equipment industry. Generally speaking, each dumbbell includes a handle, and a desired number of weights secured to opposite ends of the handle. The dumbbell is lifted up subject to gravitational force acting on the mass of the handle and the attached weights.

On some relatively advanced devices, the handle or bar is stored in proximity to a plurality of separate weights, and a selection mechanism is provided to connect a desired amount of weight to the handle. Some examples of patented barbell/dumbbell improvements and/or associated features are disclosed in U.S. Pat. No. 4,284,463 to Shields (discloses a dumbbell assembly having opposite end weights that are maintained in alignment on a base and selectively connected to a handle by means of cam driven pins on the weights); U.S. Pat. No. 4,529,198 to Hettick, Jr. (discloses a barbell assembly having opposite end weights that are maintained in alignment on respective storage members and selectively connected to a handle by means of axially movable springs); U.S. Pat. No. 4,822,034 to Shields (discloses both barbell and dumbbell assemblies having opposite end weights that are maintained in alignment on a shelf and selectively connected to a handle by means of latches on the weights); U.S. Pat. No. 5,769,762 to Towley, III et al. (discloses a dumbbell assembly having a plurality of opposite end weights that are interconnected, stored in nested relationship to one another, and selectively connected to a handle by various means); U.S. Pat. No. 5,839,997 to Roth et al. (discloses a dumbbell assembly having opposite end weights that are maintained in alignment on a base and selectively connected to a handle by means of eccentric cams on a rotating selector rod; U.S. Pat. No. 6,033,350 to Krull (discloses a dumbbell assembly having opposite end weights that are maintained in alignment on a base and selectively connected to a handle by means of selector rods that move in opposite directions to engage weights at respective ends of the handle); and U.S. Pat. No. 6,322,481 to Krull (discloses a dumbbell assembly having opposite end weights that are maintained in alignment on a base and selectively connected to a handle by means of a selector rod that engages different combinations of the weights as a function of its position relative thereto). Despite these advances and others in the field of free weight devices and adjustment methods, room for improvement remains.

SUMMARY OF THE INVENTION

Generally speaking, the present invention involves a plurality of vertically stacked weight plates that may be selectively connected to opposite ends of a handle by means of at least one selector rod. On a preferred embodiment, first and second vertical stacks of weights are supported on a base and selectively connected to respective ends of the handle by inserting the at least one selector rod beneath a desired number of weights in each stack. Many of the features and advantages of the present invention will become apparent from the more detailed description that follows.

BRIEF DESCRIPTION OF THE FIGURES OF THE DRAWING

With reference to the Figures of the Drawing, wherein like numerals represent like parts throughout the several views.

FIG. 24 is a top view of a weight base suitable for use with the exercise dumbbell of FIGS. 10–12;

FIG. 25 is a side view of the weight base of FIG. 24;

DETAILED DESCRIPTION OF A PREFERRED EMBODIMENT

Figure 1:
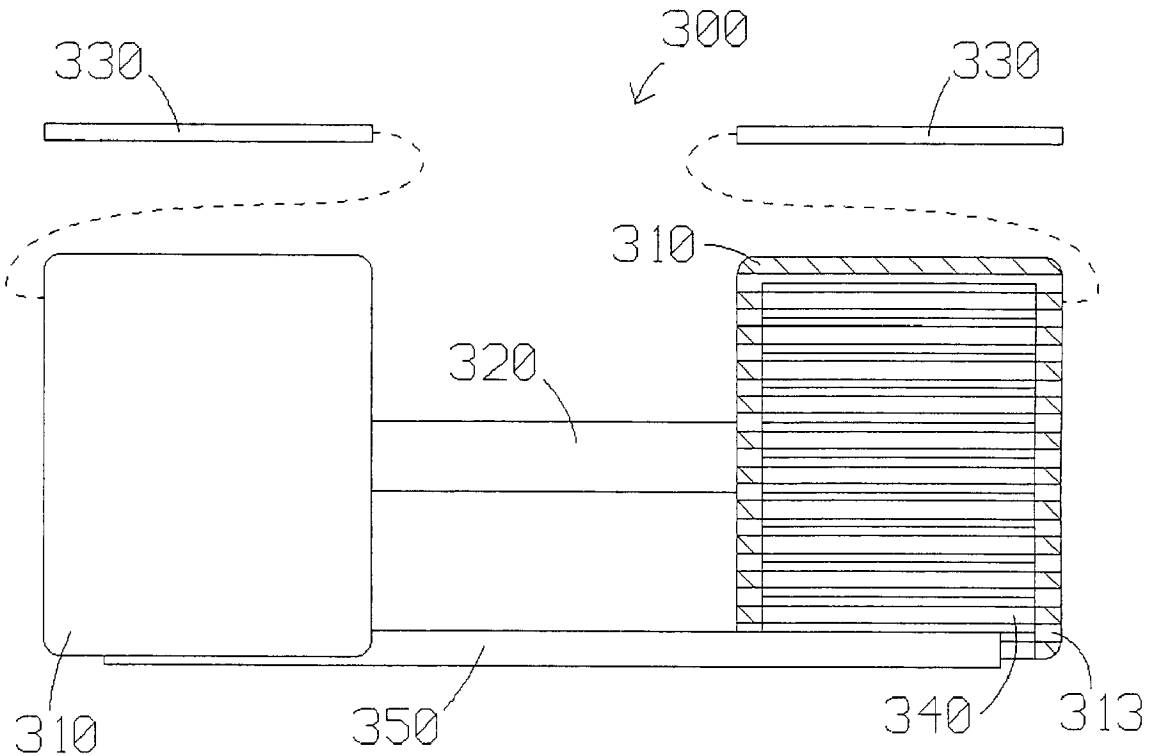
FIG. 1 is a partially sectioned, side view of a first exercise dumbbell system constructed according to the principles of the present invention.
Figure 2:
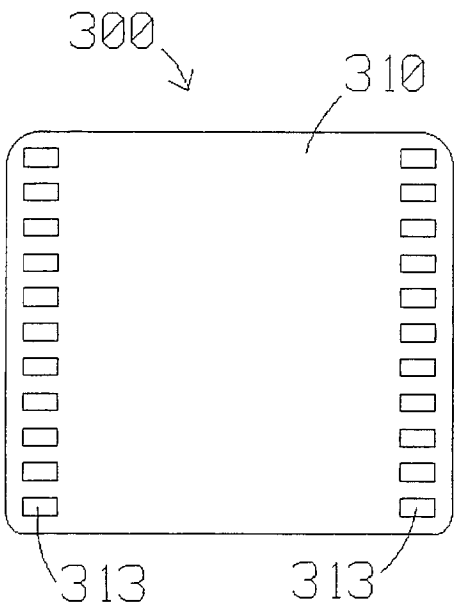
FIG. 2 is an end view of a handle member that is part of the dumbbell system of FIG. 1.
Figure 3:
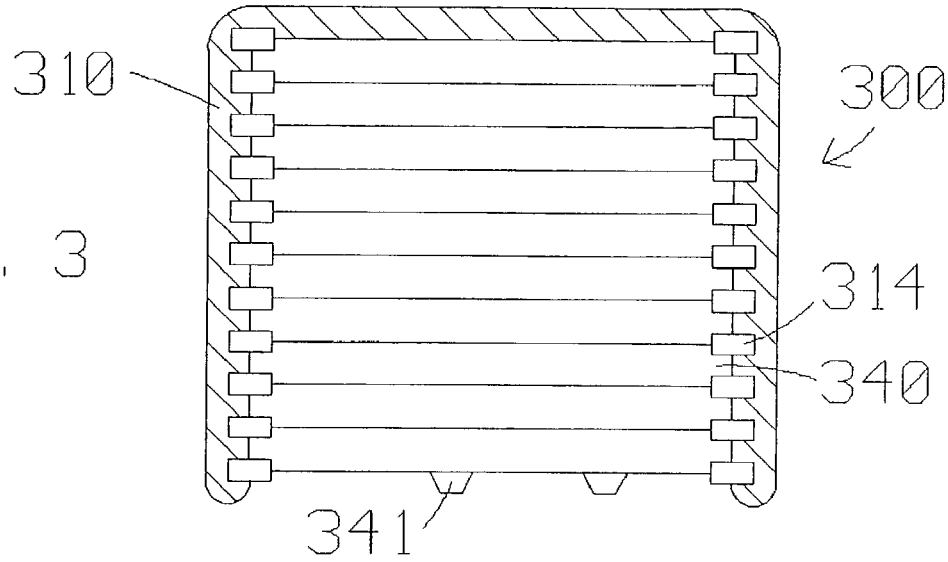
FIG. 3 is a sectioned end view of the handle member of FIG. 2 (showing the weight plates associated therewith)
Figure 4:
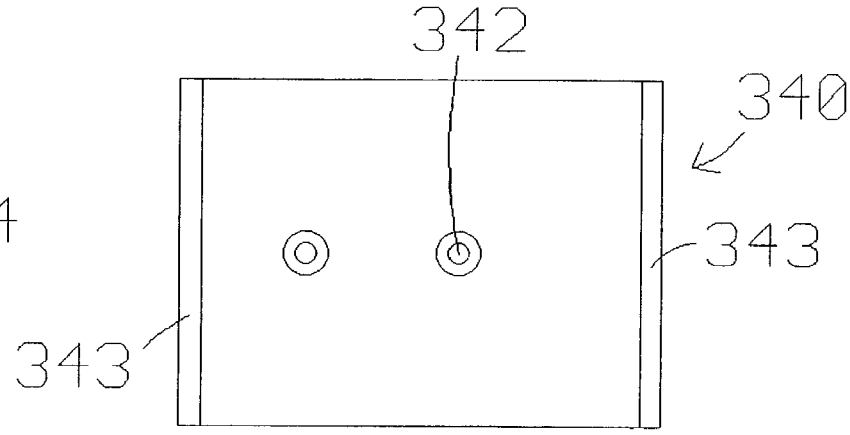
FIG. 4 is a top view of one of the weight plates shown in FIG. 2.

FIG. 1 shows a first exercise dumbbell system 300 constructed according to the principles of the present invention. The dumbbell system 300 includes first and second weight supports or housings 310 mounted on opposite ends of a cylindrical handle 320. Each of the weight housings 310 is shown as a downwardly opening box, but the invention is not limited to this particular arrangement. Rectangular holes 313 extend through the ends of the boxes 310 and align with grooves 314 extending along opposite, inwardly facing sides of the boxes 310. The holes 313 are configured to receive respective ends of U-shaped selector rod(s) 330 or 333. In this regard, a separate selector rod 330 may be provided for each box 310 (see FIG. 1), or a single selector rod 333 may be provided for both boxes 310 (see FIG. 6).

Figure 5:
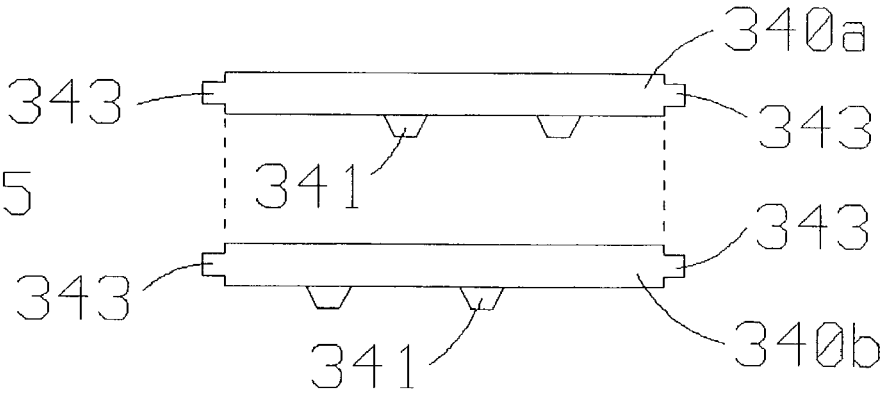
FIG. 5 is a side view of the weight plate of FIG. 4 and a second, identical weight plate that has been rotated one hundred eighty degrees relative to the weight plate of FIG. 4.

The dumbbell system 300 also includes first and second vertical stacks of weights 340 supported on opposite ends of a platform or base 350. All of the weights 340 may be made identical for purposes of manufacturing efficiency, but the present invention is not limited in this regard. Each weight 340 is rotated one hundred eighty degrees relative to adjacent upper and lower weights 340, as shown in FIG. 5. Each weight 340 may be described as a plate having at least one registration peg 341 that protrudes downward from the bottom of the plate, and at least one mating registration opening 342 that extends downward into the top of the plate. When the weights 340 are arranged as shown in FIG. 5, the pegs 341 on the upper weight 340*a* align with the openings 342 in the lower weight 340*b*. The pegs 341 and the openings 342 cooperate to maintain the stacked weights 340 in vertical alignment with one another.

Other alignment arrangements may be used without departing from the scope of the present invention. For example, the two symmetrically configured pegs 341 and associated holes 342 may be replaced by a single peg and associated hole having a square or other asymmetrical configuration. Moreover, a square post may extend upward from each end of the weight base 350 and through a mating hole in each weight 340 in a respective stack.

In the depicted system 300, the weight base 350 is provided with registration openings 352 to receive the registration pegs 341 on the lowermost weight 340 when it is in either of two diametrically opposed orientations. The weight base 350 maintains the weights 340 in two vertical stacks at a particular distance apart from one another. Among other things, the base 350 may also be configured for selective connection to the housings 310 to enhance portability of the system 300.

Upper and lower notches extend along the opposite sides of each weight 340 to define relative thinner flanges or rails 343. The rails 343 on any two adjacent weights 340 cooperate to define a groove that mirrors a respective groove 314 in the sidewall of a respective box 310. Each pair of "mirrored" grooves defines a channel or passage that is sized and configured to receive a respective prong of a selector rod 330 or 333. In other words, the selector rod 330 or 333 may be inserted directly above the flanges 343 on the lower weight 340*b*, and directly beneath the flanges 343 on the upper weight 340*a*, thereby capturing or selecting the upper weight 340*a* (and any weights above the upper weight 340*a*) to the exclusion of the lower weight 340*b* (and any weights below the lower weight 340*b*). Indicia may be provided on the outwardly facing ends of the boxes 310 to indicate the "selected" weight associated with each pair of openings 313. On alternative embodiments, different forms of selector rod(s) may have only a single shaft, insert through holes in the weights, and/or not require grooves in the housings.

FIG. 1 shows separate first and second selector rods 330 for respective first and second boxes 310. Such an arrangement may be considered advantageous to the extent that a different number of weights 340 may be secured within each box 310 (thereby providing twice as many available weight increments), and/or no portion of either selector rod 330 occupies the space between the boxes 310.

Figure 6:
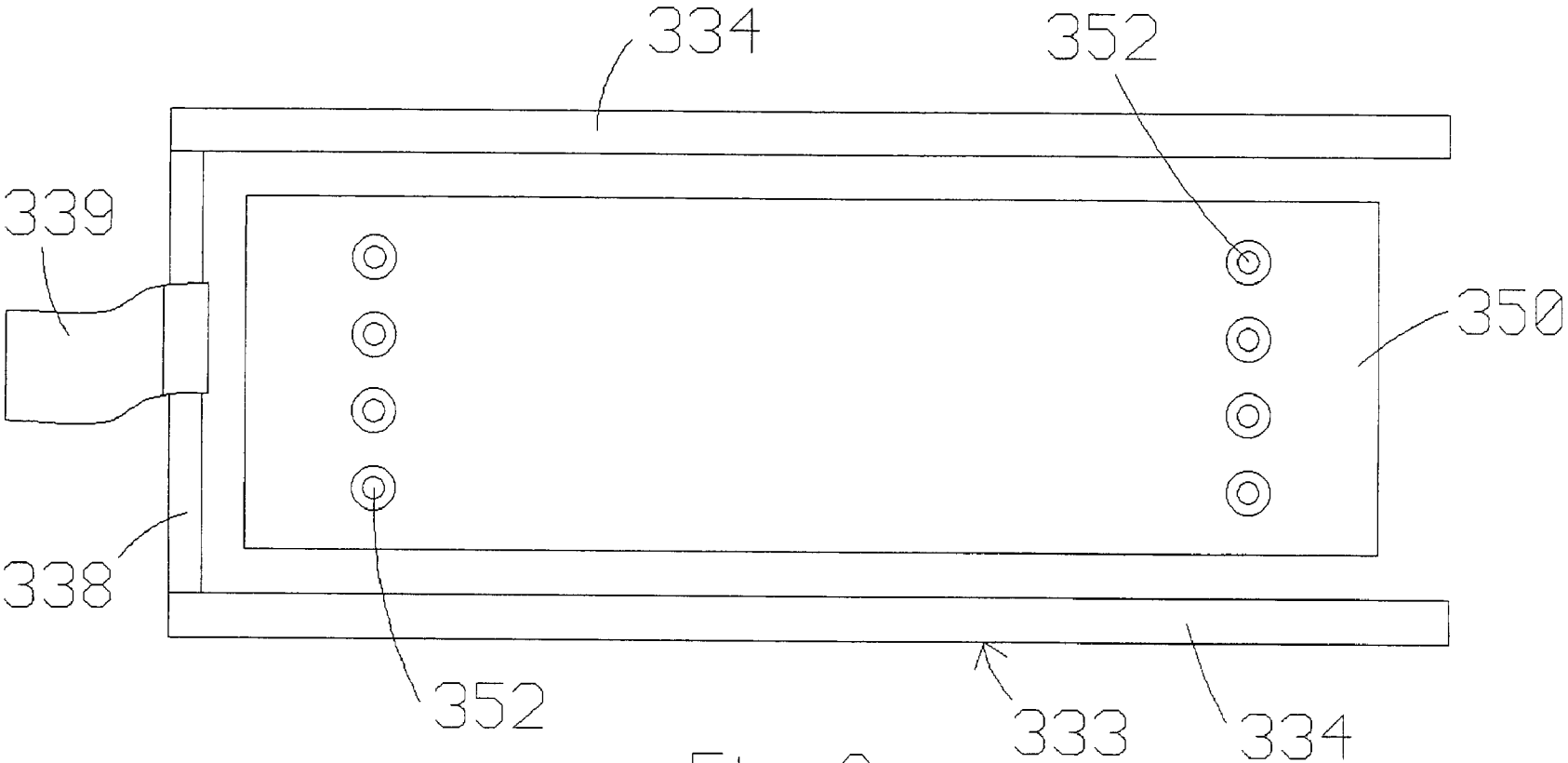
FIG. 6 is a top view of a selector rod and a weight base that are suitable for use with the dumbbell system of FIG. 1.
Figure 7:
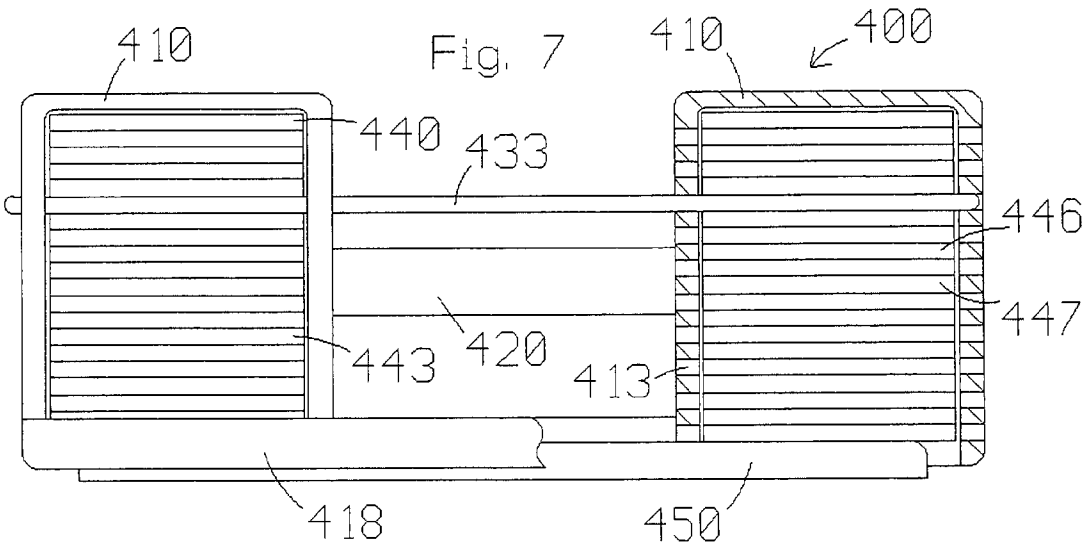
FIG. 7 is a partially sectioned side view of a second exercise dumbbell system constructed according to the principles of the present invention.

FIGS. 6–7 show a single selector rod 333 that is sufficiently long to extend through both boxes 310. This alternative selector rod 333 may be considered advantageous to the extent that only one maneuver is required to adjust the amount of selected weight on each end of the dumbbell 300.

Like each of the selector rods 330, the selector rod 333 includes first and second parallel prongs 334 and an intermediate bar 338 interconnected therebetween. The intermediate bar 338 is shown with a different cross-section than the prongs 334 simply to emphasize that various arrangements are possible without departing from the scope of the present invention. Also, each selector rod 330 or 333 may be configured for latching to a respective box or boxes 310 by various means, including for example, friction fit, snap fit, magnetic force, hook-and-loop fasteners, and/or a spring detent. Some examples of such arrangements are disclosed in U.S. Pat. No. 6,322,481, which is incorporated herein by reference. Also, a cloth strap 339 (or some other handling means) may be secured about the intermediate bar 338 to facilitate withdrawal of the selector rod(s) 330 or 333 from the boxes 313.

Figure 8:
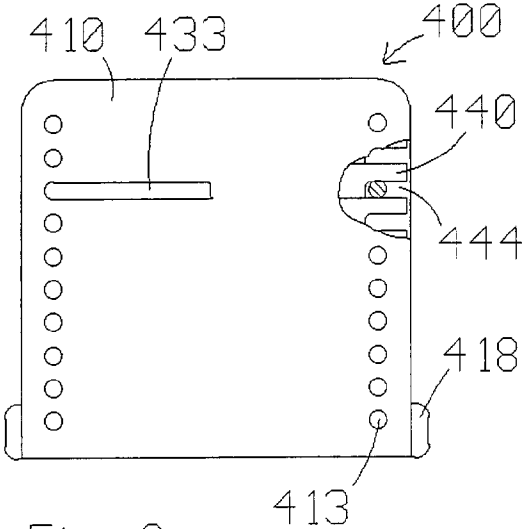
FIG. 8 is a partially sectioned end view of the dumbbell of FIG. 7 (shown without the weight supporting base depicted in FIG. 7)

In order to emphasize that the present invention is not limited to any particular embodiment or specific combination of features, FIGS. 7–8 show another dumbbell system 400 constructed according to the principles of the present invention. The dumbbell system 400 similarly includes first and second weight supports or housings 410 mounted on opposite ends of a cylindrical handle 420. Each of the weight housings 410 may be described as having an inverted U-shaped member that defines opposite end walls (but no side walls). On each side of the dumbbell system 400, a reinforcing bar 418 is preferably provided along the length of the dumbbell and rigidly secured to each end wall of each housing 410. Circular holes 413 extend through the ends of the housings 410 and are configured to receive respective ends of U-shaped selector rod 433 (which extends the length of the dumbbell, but could be replaced by two separate selector rods).

The dumbbell system 400 also includes first and second vertical stacks of weights 440 supported on opposite ends of a platform or base 450. The weights 440 may be similar in construction to the weights 340, except for the manner in which they are configured for engagement by the selector rod 430. In this regard, only lower notches or grooves 444 extend along the opposite sides of each weight 440 to define a relative thinner (and longer) flange or rail. As shown in FIG. 8, the selector rod 430 may be inserted into the groove designated as 444 in order to capture or select the weight designated as 440 (and all weights above the engaged weight 440).

In the event it is considered undesirable to position the selector rod 433 in lateral alignment with the handle 420 (because of potential interference problems with the user's hand), one possible solution (already discussed above) is to use separate first and second selector rods for respective ends of the dumbbell. Another possible solution is to provide the members or "blanks" designated as 446 and 447 in FIG. 7 in the form of relatively lightweight spacers, as opposed to relatively heavy weights, and eliminate the associated holes 413 in the housings 410, as well as any accompanying indicia of the selected weight. Such a modification would reduce both the number of available weight increments and the maximum available weight.

Figure 9:
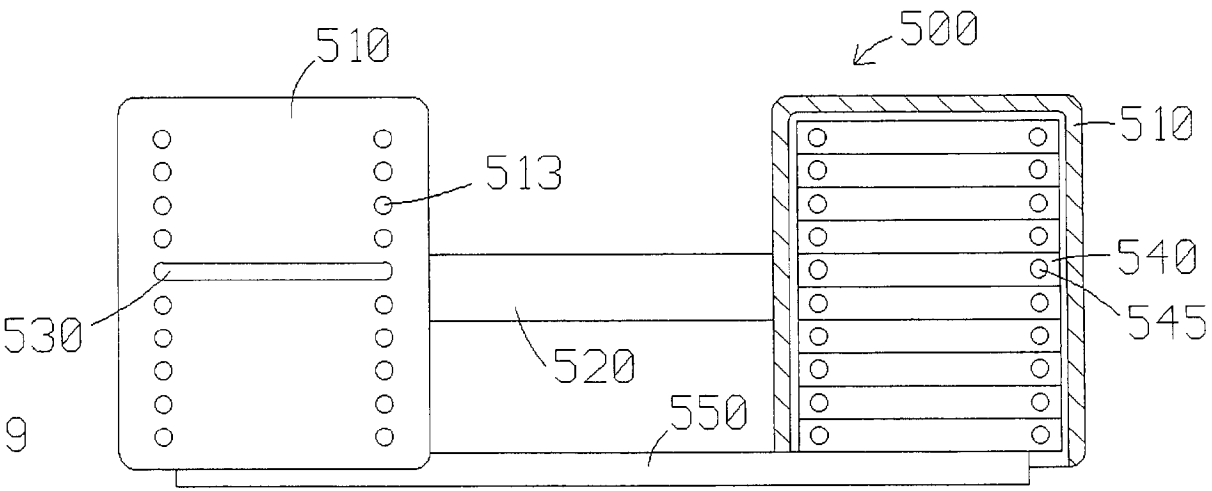
FIG. 9 is a partially sectioned side view of a third exercise dumbbell system constructed according to the principles of the present invention.

Additional variations of the present invention may be described with reference to FIG. 9, which shows yet another dumbbell system 500 constructed according to the principles of the present invention. The dumbbell system 500 similarly includes first and second weight supports or housings 510 mounted on opposite ends of a cylindrical handle 520. Each of the weight housings 510 may be described as a downwardly opening box. Circular holes 513 extend through at least one side of each of the boxes 510 and are configured to receive respective ends of respective U-shaped selector rods 530.

The dumbbell system 500 also includes first and second vertical stacks of weights 540 supported on opposite ends of a platform or base 550. The weights 540 may be similar in construction to the weights 340, except for the manner in which they are configured for engagement by the selector rods 530. In this regard, the weights 540 are simple parallelepiped plates with laterally extending holes 545 formed therein to receive respective ends of respective selector rods 530. As shown in FIG. 9, the selector rod 530 may be inserted into the hole designated as 545 in order to capture or select the weight designated as 540 in (and all weights above the engaged weight 540). Among other things, the holes 545 may alternatively be provided in the form of downwardly opening grooves formed in the bottom of each weight.

Figure 10:
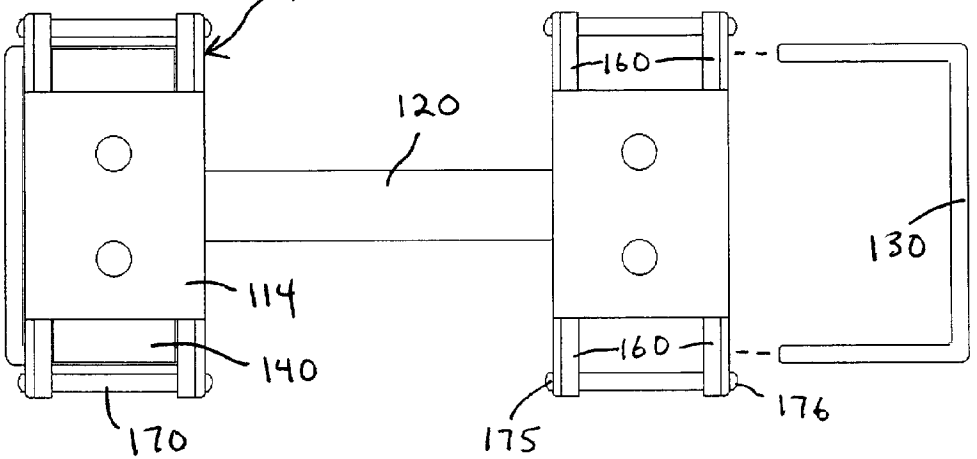
FIG. 10 is a top view of a fourth exercise dumbbell constructed according to the principles of the present invention.
Figure 11:
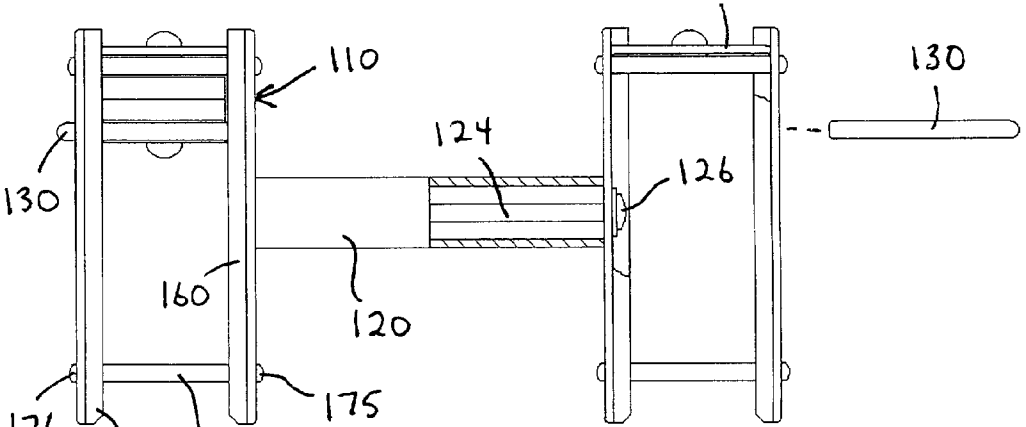
FIG. 11 is a partially sectioned side view of the exercise dumbbell of FIG. 10.
Figure 12:
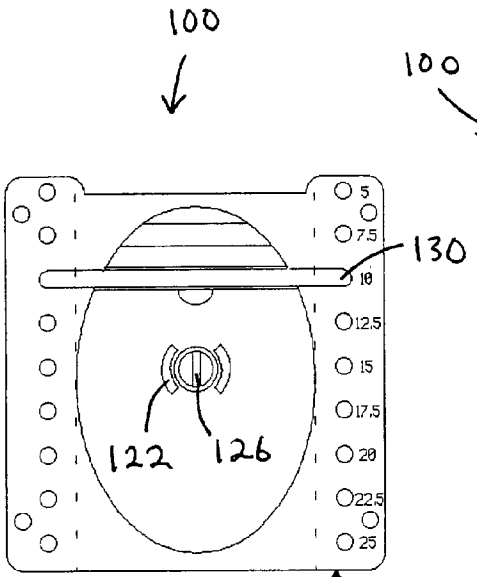
FIG. 12 is an end view of the exercise dumbbell of FIG. 10.
Figure 13:
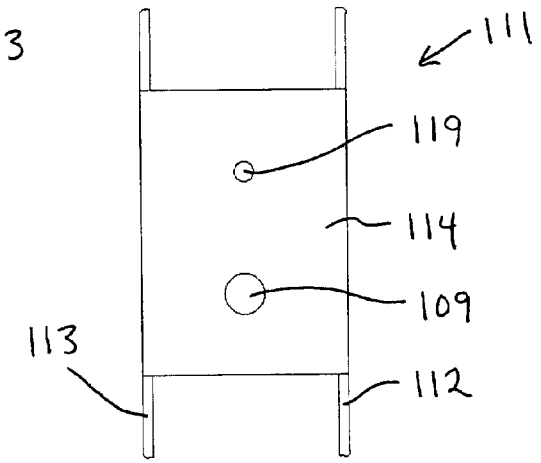
FIG. 13 is a top view of a weight support that is part of the exercise dumbbell of FIGS. 10–12.
Figure 14:
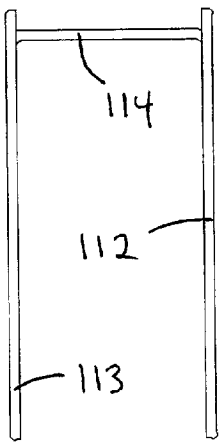
FIG. 14 is a side view of the weight support of FIG. 13.
Figure 16:
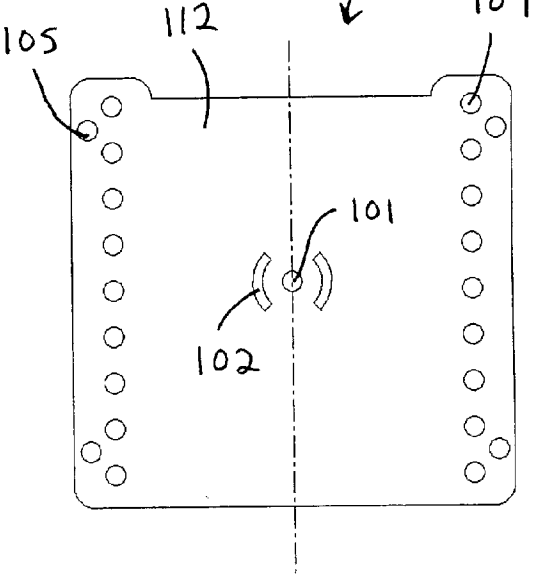
FIG. 16 is an opposite end view of the weight support of FIG. 14.
Figure 15:
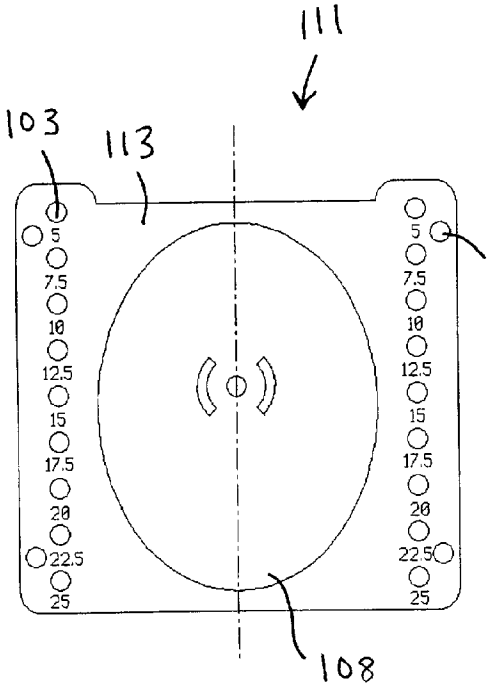
FIG. 15 is an end view of the weight support of FIG. 14.

FIGS. 10–12 show yet another dumbbell 100 constructed according to the principles of the present invention. The dumbbell 100 similarly includes first and second weight supports or housings 110 mounted on opposite ends of a cylindrical handle 120 to define a lifting member. The housings 110 are configured and arranged to fit over first and second vertical stacks of weights 140 disposed on respective ends of a base 150 (see FIGS. 24–25). The weights 140 are selectively connected to the lifting member by means of at least one selector rod 130 that is inserted through the housings 110 and beneath a desired number of the weights 140.

The weights 140 are described with reference to FIGS. 20–23. The weights 140 are preferably made identical to one another, but the present invention is not limited to such an arrangement. Each weight 140 may be described as a block of steel having opposite end walls, and tabs 142 that project outward from respective end walls. The tabs 142 cooperate with the end walls of the block to define respective notches 143. A hole 147 extends vertically through the weight 140, and upper and lower nubs 149 and 148 extend outward from respective top and bottom walls of the weight 140. As suggested by FIG. 23, the hole 147 in a first weight 140*a* is sized and configured to receive the nub 149 on a second weight 140*b* stacked immediately below the first weight 140*a* and rotated one hundred and eighty degrees relative thereto, and similarly, the hole 147 in the second weight 140*b* is sized and configured to receive the nub 148 on the first weight 140*a*. The nubs 148 and 149 may be integrally formed on the weights 140, or defined by a nut and bolt combination secured to the weight 140 via a relatively smaller vertical hole through the weight 140.

When at rest, the weights 140 are supported by the base 150 shown by itself in FIGS. 24–25. As shown in FIG. 24, the base 150 has a planform that is similar to that of a traditional dumbbell. The base 150 includes first and second weight supporting portions 151 that are interconnected by an intermediate portion 152. A platform 154 extends upward from each weight supporting portion 151 and preferably has a planform that is similar to that of the weights 140. An opening 157 extends downward into each platform 154, and a nub 159 projects upward from each platform 154. The openings 157 and nubs 159 are configured and arranged like the holes 147 and nubs 149 on the weights 140. In other words, the base 150 is configured to support respective vertical stacks of weights 140 at a fixed horizontal distance from one another.

The handle 120 maintains a fixed horizontal distance between the housings 110 to facilitate alignment of each housing 110 with a respective stack of weights 140. Each housing 110 includes an inverted U-shaped member 111, one of which is shown by itself in FIGS. 13–16. Each member 111 is preferably a steel plate that has been bent into a U-shaped configuration, with an intermediate or top wall interconnected between opposite end walls 112 and 113. Aligned holes 103 and 104 extend through respective end walls 113 and 112 to accommodate distal ends of at least one U-shaped selector rod. The depicted embodiment 100 is shown with a respective U-shaped selector rod 130 for each housing 110. As shown in FIGS. 11–12, each rod 130 is configured to fit into respective holes 103 and 104 and beneath the tabs 142 on any desired weight 140.

Aligned holes 105 and 106 extend through respective end walls 112 and 113 to accommodate reinforcing supports (discussed below). Arcuate slots 102 extend through the inner end wall 112 to accommodate tabs 122 on a respective end of the handle 120, and a hole 101 extends through the inner end wall to accommodate a bolt 124 that extends through the handle 120. The outer end wall 113 is provided with a relatively large, elliptical opening 108 that facilitates handling of the at least one selector rod (and reduces the weight of the lifting member in the absence of any weight plates). A relatively small hole 119 may be provided in the top wall 114 to accommodate a nut and bolt combination configured like the nubs 148 and 149 discussed above, and a relatively larger hole 109 is provided in the top wall 114 to accommodate the nub 149 on an uppermost weight 140 in a respective stack.

The handle 120 is preferably a cylindrical tube that is made of steel. The ends of the handle 120 are provided with tabs 122 (see FIG. 12) that insert into respective slots 122 in respective end walls 112. As shown in FIG. 11, the bolt 124 is inserted through one of the end walls 112, then through the handle 120, then through the other end wall 112, and then is threaded into a nut. Washers may be provided between the nut and the head 126 of the bolt 124 and respective end walls 112.

On each U-shaped member 111, strips or shoulders 160 are preferably provided on opposing faces of the end walls 112 and 113. As suggested by FIG. 10, four strips 160 are mounted on each U-shaped member 111. One of the strips

Figure 17:
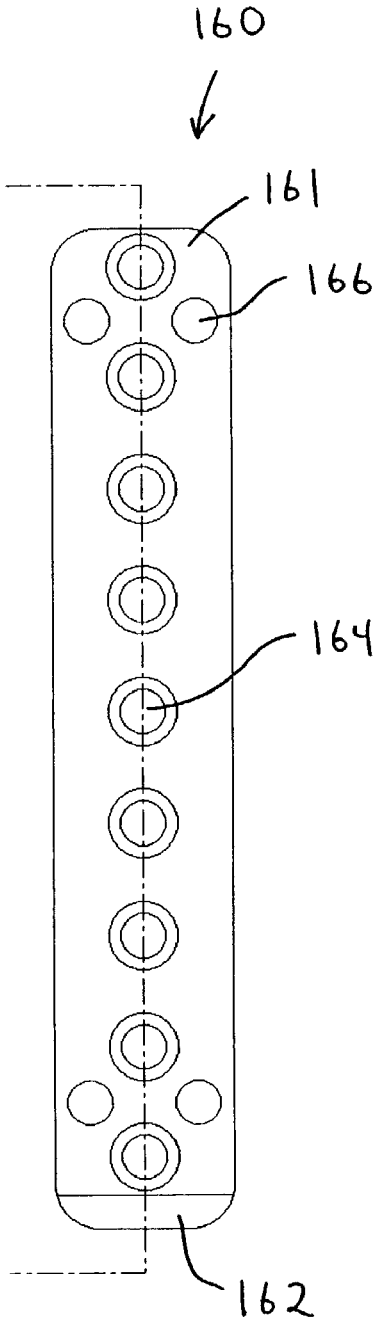
FIG. 17 is an end view of a spacer that is part of the exercise dumbbell of FIGS. 10–12.
Figure 18:
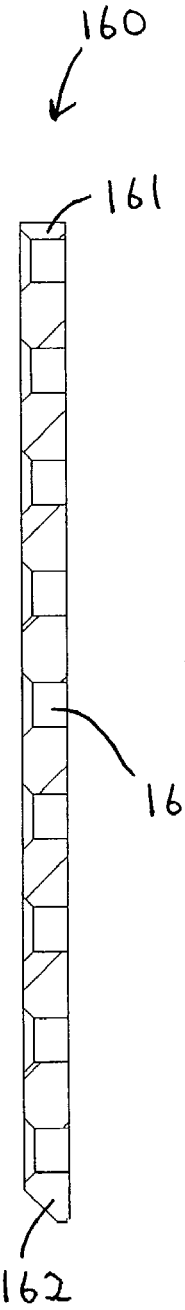
FIG. 18 is a sectioned side view of the spacer of FIG. 17.
Figure 19:
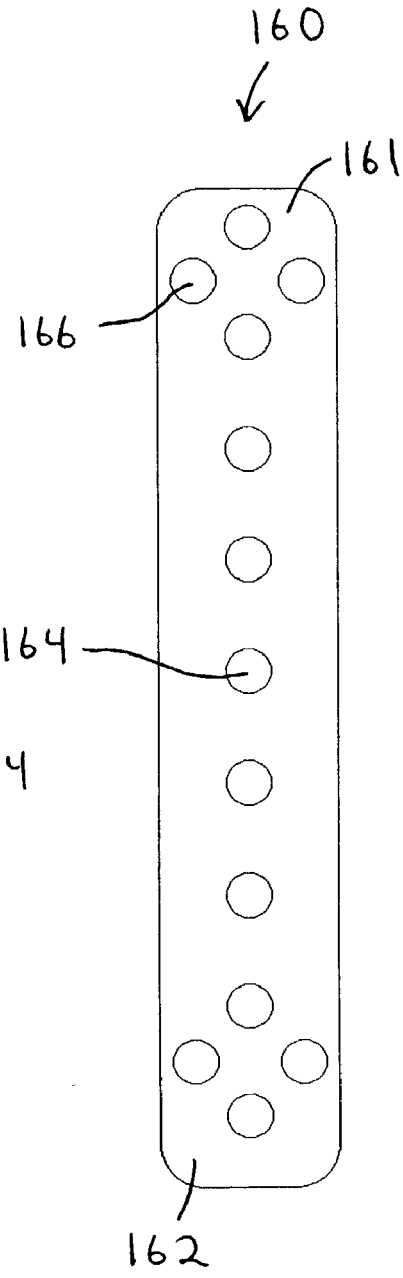
FIG. 19 is an opposite end view of the spacer of FIG. 17.
Figure 20:
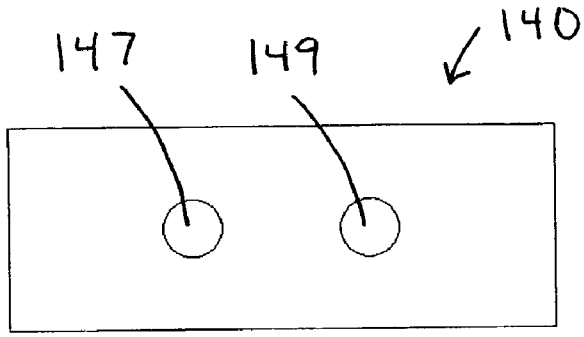
FIG. 20 is a top view of a weight that is part of the exercise dumbbell of FIGS. 10–12.
Figure 21:
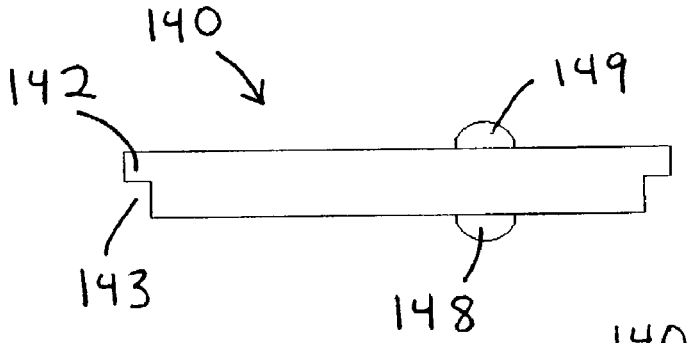
FIG. 21 is a side view of the weight of FIG. 20.
Figure 22:
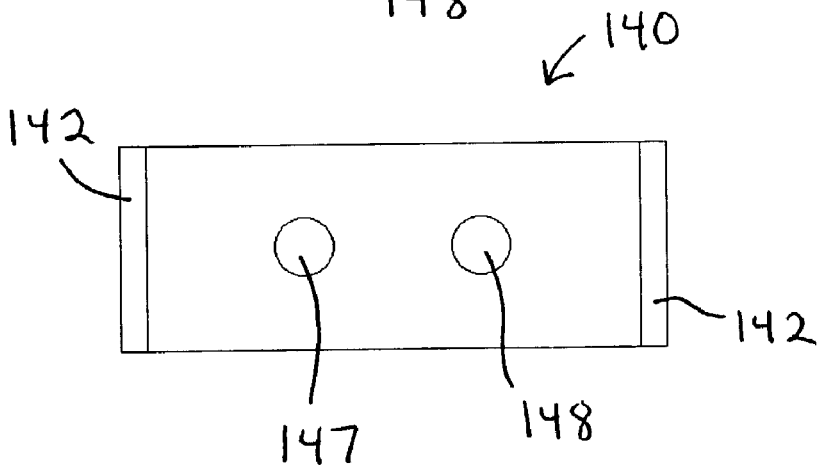
FIG. 22 is a bottom view of the weight of FIG. 20.
Figure 23:
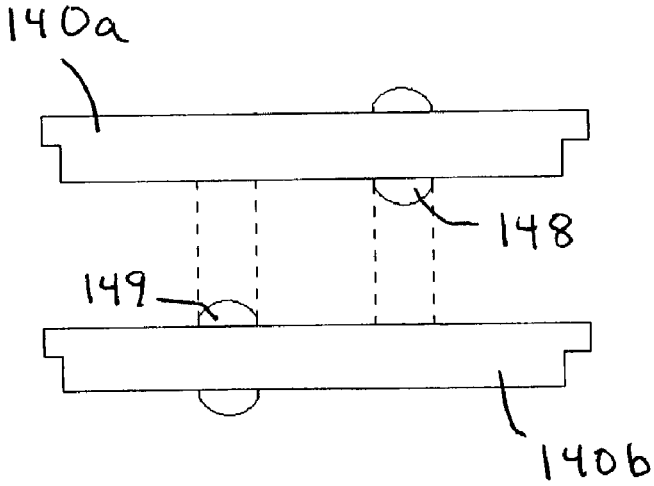
FIG. 23 is a side view of the weight plate of FIG. 20 and a second, identical weight plate that has been rotated one hundred eighty degrees relative to the weight plate of FIG. 20.

160 is shown by itself in FIGS. 17–19. All of the strips 160 may be made identical for purposes of manufacturing efficiency. The strips 160 are preferably made of plastic and formed by injection molding.

Each strip 160 extends from an upper end 161 to a lower end 162 that is preferably beveled. Holes 164 extend through the strip 160 and align with a respective set of holes 103 or 104 in a respective end wall 113 or 112. The holes 164 are preferably beveled at one end to help guide the distal ends of the selector rods 130 into desired holes 104 in the inner end walls 112 of respective U-shaped members 111. Holes 166 extend through the strip 160 and align with respective holes 105 and 106 in a respective end wall 112 or 113. Four holes 166 are provided in each strip 160 to accommodate different orientations of the strips 160 relative to the U-shaped members 111. The strips 160 provide low friction bearing surfaces on opposite sides of the weights 140, contribute to support and guidance of the selector rods 130, and maintain gaps between the weights 140 and respective end walls 112 and 113 (thereby accommodating the head 126 of the bolt 124, as well as the nut associated therewith).

Supports 170 are preferably provided to help hold the strips 160 in place and to reinforce the U-shaped members 111. FIGS. 10–11 show two supports 170 secured between each pair of strips 160. The supports 170 are preferably cylindrical tubes made of plastic. A bolt 175 is inserted through a respective inner end wall 112, then through a respective strip 160, then through a respective support 170, then through another respective strip 160, then through a respective outer end wall 113, and then is threaded into a mating nut 176. This arrangement ensures that a desired amount of space is maintained between the inner end wall 112 and the outer end wall 113 on each U-shaped member.

Figure 27:
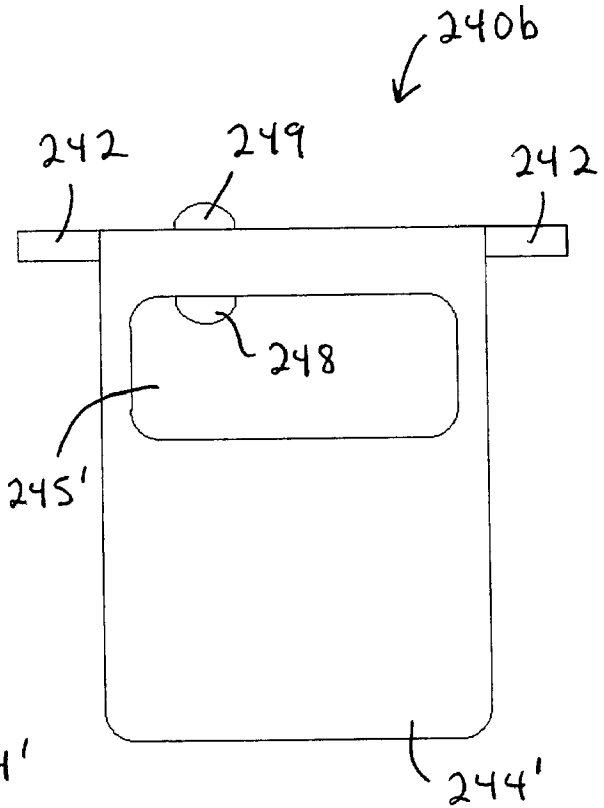
FIG. 27 is an opposite end view of a second alternative embodiment weight suitable for use on the exercise dumbbell of FIGS. 10–12.
Figure 28:
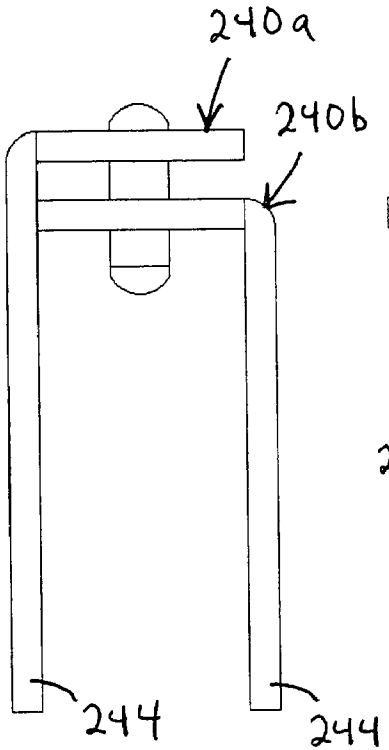
FIG. 28 is a side view of the weights of FIGS. 26 and 27 stacked relative to one another.
Figure 26:
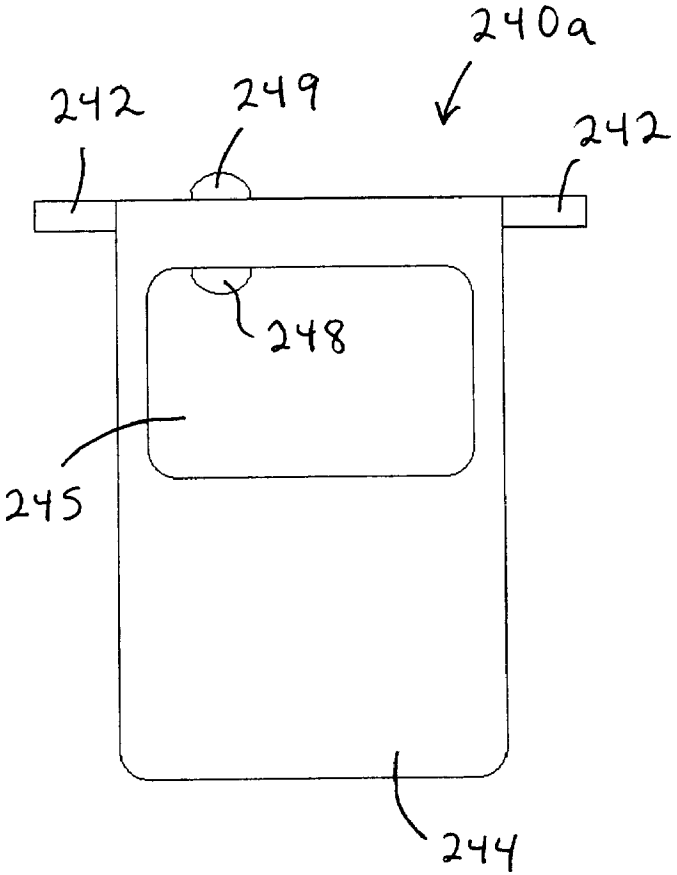
FIG. 26 is an end view of a first alternative embodiment weight suitable for use on the exercise dumbbell of FIGS. 10–12.

The foregoing embodiments load weights onto a lifting member from the top down. As a result, some of the lower weight configurations are likely to feel top heavy. This effect may be reduced by raising the location of the handle member relatively to the housings (as shown in FIG. 11). Also, the weights may be configured to give a more balanced "feel" to the dumbbell. For example, FIGS. 26–28 show weights 240*a* and 240*b* that may used as the top two weights in each stack associated with the dumbbell 100.

Each of the weights 240*a* and 240*b* may be described as an L-shaped plate with a horizontally extending portion that is similar to the upper portion of the weights 140, and a vertically extending portion 244 that takes the place of the lower portion of the weights 140. Tabs 242 extend outward from opposite ends of the horizontally extending portion, and nubs 248 and 249 project outward from the top and bottom surfaces of the horizontally extending portion. Depressions, rather than holes, are provided in upper and lower surfaces of the horizontally extending portion of the weight 240*a* to engage a bolt or nut on the housing 111 and a nub 249 on the next lowest weight 240*b*. An opening 245 is provided in the vertically extending portion 244 of the weight 240*a* to reduce the overall mass of the weight 240*a* in a manner that also lowers the center of mass. The weight 240*b* is similar to the weight 240*a*, except that the vertically extending portion 244' is shorter, the associated opening 245' is smaller, and the locations of the nubs 248 and 249 and the depressions are reversed. FIG. 28 shows the two weights 240*a* and 240*b* stacked relative to one another and defining a gap between the vertically extending portions 244 and 244' to accommodate the remainder of the weights 140 in the stack.

The present invention may also be described in terms of various methods, with reference to the foregoing embodiments, for example. One such method involves adjusting resistance to exercise, and comprises the steps of providing a handle with first and second weight housings at respective first and second ends of the handle; providing a base; providing first and second vertical stacks of weights; positioning the stacks of weights on the base to align with respective weight housings; resting the handle on at least one of the base and the stacks of weights; and inserting at least one selector rod through the housings and beneath a desired weight in each of the stacks.

The present invention has been described with reference to specific embodiments and a particular application. However, the present invention may be implemented in various ways to achieve various results. Among other things, the depicted embodiments have features that may be mixed and matched to arrive at additional embodiments. Recognizing that persons skilled in the art are likely to derive additional embodiments and/or improvements from this disclosure, the scope of the present invention should be limited only to the extent of the following claims.

What is claimed is:

1. An exercise dumbbell system, comprising:

a handle having a first end, an opposite, second end, and an intermediate portion sized and configured for grasping;

a first weight housing connected to the first end;

a second weight housing connected to the second end;

a first vertical stack of weights aligned with the first weight housing;

a second vertical stack of weights aligned with the second weight housing; and at least one selector rod inserted through the first weight housing and into engagement with a desired weight in the first vertical stack, and through the second weight housing and into engagement with a desired weight in the second vertical stack.

2. The exercise dumbbell system of claim 1, further comprising a means for maintaining the weights in the first vertical stack in alignment with one another, and for maintaining the weights in the second vertical stack in alignment with one another.

3. The exercise dumbbell system of claim 1, further comprising a base disposed beneath each said stack of weights, wherein the base is configured to maintain a fixed, horizontally measured distance between the first vertical stack of weights and the second vertical stack of weights.

4. The exercise dumbbell system of claim 1, wherein all of the weights are identical to one another.

5. The exercise dumbbell system of claim 1, wherein each said stack of weights includes a first weight disposed on top of an identical second weight, and the first weight occupies a first orientation, and the second weight occupies a second orientation, rotated one hundred eighty degrees relative to the first orientation.

6. The exercise dumbbell system of claim 1, wherein each said stack of weights includes a first weight disposed on top of a second weight, and at least one registration peg projects downward from a bottom surface on each said first weight, and for each said registration peg, a mating registration hole extends downward into a top surface on a respective second weight.

7. The exercise dumbbell system of claim 6, wherein each said first weight occupies a first orientation, and each said second weight occupies a second orientation, rotated one hundred eighty degrees relative to the first orientation, thereby aligning each said registration peg on each said first weight with a respective registration hole in a respective second weight.

8. The exercise dumbbell system of claim 1, wherein each said stack of weights includes a first weight disposed on top of a second weight, and each said first weight and respective said second weight cooperate to define at least one weight groove sized and configured to receive the at least one selector rod.

9. The exercise dumbbell system of claim 8, wherein each said housing defines a housing groove that cooperates with a respective weight groove to define a respective channel sized and configured to receive the at least one selector rod.

10. The exercise dumbbell system of claim 9, wherein each said housing has an end wall, and for each said channel, a respective opening extends through the end wall and aligns with said channel.

11. The exercise dumbbell system of claim 8, wherein each said first weight and each said second weight have opposite top and bottom surfaces, and at least one registration peg projects from one of the surfaces, and for each said registration peg, a mating registration hole extends into an opposite one of the surfaces.

12. The exercise dumbbell system of claim 11, wherein each said first weight occupies a first orientation, and each said second weight occupies a second orientation, rotated one hundred eighty degrees relative to the first orientation, thereby aligning each said registration peg on each said first weight with a respective registration hole in a respective second weight.

13. The exercise dumbbell system of claim 1, wherein each said stack of weights includes a first weight disposed on top of a second weight, and each said first weight and respective said second weight cooperate to define first and second grooves extending along opposite sides thereof, and the at least one selector rod includes a U-shaped member having first and second prongs that are selectively inserted into respective grooves.

14. The exercise dumbbell system of claim 13, wherein each said first weight and each said second weight have opposite top and bottom surfaces, and at least one registration peg protrudes from one of the surfaces, and for each said registration peg, a mating registration hole extends into an opposite one of the surfaces.

15. The exercise dumbbell system of claim 14, wherein each said first weight occupies a first orientation, and each said second weight occupies a second orientation, rotated one hundred eighty degrees relative to the first orientation, thereby aligning each said registration peg on each said first weight with a respective registration hole in a respective second weight.

16. The exercise dumbbell system of claim 1, wherein the at least one selector rod includes a U-shaped member having first and second prongs that engage opposite sides of the desired weight in each said stack of weights.

17. The exercise dumbbell system of claim 16, wherein the at least one selector rod includes an intermediate portion interconnected between the first and second prongs, and a means, connected to the intermediate portion, for facilitating withdrawal of the prongs from each said weight housing.

18. The exercise dumbbell system of claim 16, wherein the prongs are movable along respective openings in each said weight housing.

19. The exercise dumbbell system of claim 1, wherein the at least one selector rod includes a first selector rod associated with the first weight housing, and a discrete, second selector rod associated with the second weight housing.

20. The exercise dumbbell system of claim 1, wherein each said housing includes an inverted U-shaped member that is sized and configure to fit over a respective stack of weights.

21. The exercise dumbbell system of claim 20, wherein each said U-shaped member has opposing end walls, and shoulders protrude from respective end walls and toward one another to maintain space between the end walls and a respective stack of weights.

22. The exercise dumbbell system of claim 20, wherein each said U-shaped member has opposing end walls, and each said housing includes at least one support interconnected between respective said end walls.

23. The exercise dumbbell system of claim 1, wherein each said housing has opposing walls that bound opposite sides of a respective stack of weights, and shoulders protrude from respective opposing walls and toward one another to maintain space between the opposing walls and a respective stack of weights.

24. The exercise dumbbell system of claim 23, wherein the opposing walls are made of steel, and the shoulders are made of plastic.

25. The exercise dumbbell system of claim 1, wherein each stack of weights includes at least one weight having a horizontally extending portion and a vertical extending portion, and the horizontally extending portion overlies a next lowest weight in a respective stack, and the vertically extending portion extends downward past a side of the next lowest weight in a respective stack.

26. An exercise dumbbell system, comprising:

a lifting member having a handle portion configured for grasping, a first weight housing connected to a first end of the handle portion, and a second weight housing connected to an opposite, second end of the handle portion;

a base;

a first vertical stack of weights disposed on the base and aligned with the first weight housing;

a second vertical stack of weights disposed on the base and aligned with the second weight housing; and at least one selector rod inserted through the first weight housing and into engagement with a desired weight in the first vertical stack, and through the second weight housing and into engagement with a desired weight in the second vertical stack.

27. A method of adjusting resistance to exercise, comprising the steps of:

providing a handle with first and second weight housings at respective first and second ends of the handle;

providing a base;

providing first and second vertical stacks of weights;

positioning the stacks of weights on the base to align with respective weight housings;

resting the handle on at least one of the base and the stacks of weights; and inserting at least one selector rod through the housings and beneath a desired weight in each of the stacks.

* * * * *